US012577749B2

(12) United States Patent
Doy et al.

(10) Patent No.: US 12,577,749 B2
(45) Date of Patent: Mar. 17, 2026

(54) COMPACTION-BASED DYNAMIC AUTOMATED COMPACTION PLAN

(71) Applicant: Caterpillar Paving Products Inc., Brooklyn Park, MN (US)

(72) Inventors: Nathaniel S. Doy, Maple Grove, MN (US); John L. Marsolek, Watertown, MN (US); Nicholas A. Oetken, Brooklyn Park, MN (US); Mark A. Tarvin, Canton, IL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 1104 days.

(21) Appl. No.: 17/571,926

(22) Filed: Jan. 10, 2022

(65) Prior Publication Data

US 2023/0220645 A1 Jul. 13, 2023

(51) Int. Cl.
*E01C 21/00* (2006.01)
*E02D 3/046* (2006.01)

(52) U.S. Cl.
CPC ..... *E02D 3/046* (2013.01); *E01C 21/00* (2013.01)

(58) Field of Classification Search
CPC .... E01C 19/282; E01C 19/286; E01C 19/288; E01C 21/00; E02D 3/046
See application file for complete search history.

(56) References Cited

U.S. PATENT DOCUMENTS

| | | | | |
|---|---|---|---|---|
| 8,770,887 | B1 * | 7/2014 | Geier | E01C 19/286 200/61.54 |
| 9,423,332 | B2 | 8/2016 | Corcoran et al. | |
| 10,036,129 | B2 | 7/2018 | Oetken et al. | |
| 10,640,943 | B2 | 5/2020 | Marsolek et al. | |
| 2007/0150147 | A1 | 6/2007 | Rasmussen et al. | |
| 2016/0168806 | A1 | 6/2016 | Corcoran et al. | |
| 2017/0159246 | A1 * | 6/2017 | Pistrol | E01C 19/288 |
| 2017/0284036 | A1 * | 10/2017 | Rio | E01C 19/288 |
| 2017/0306575 | A1 * | 10/2017 | Utterodt | E01C 19/288 |
| 2019/0382966 | A1 * | 12/2019 | Laugwitz | E01C 19/26 |
| 2022/0205191 | A1 * | 6/2022 | Moisio | E01C 19/282 |
| 2023/0287636 | A1 * | 9/2023 | Huhn | E01C 19/282 |
| 2023/0326263 | A1 * | 10/2023 | Laugwitz | E01C 19/26 701/33.4 |

FOREIGN PATENT DOCUMENTS

| | | | |
|---|---|---|---|
| EP | 3447191 | | 2/2019 |
| JP | 2015161082 A | * | 9/2015 |
| JP | 6214428 | | 9/2017 |

* cited by examiner

*Primary Examiner* — Abigail A Risic

(57) ABSTRACT

A method for controlling a compactor machine can include inputting a compaction specification into a controller for compacting a work area; inputting a compaction target value into the controller; while compacting, evaluating an actual compaction value; and if the actual compaction value reaches the compaction target value, the controller being configured to turn off a vibratory system of the compactor machine while the compactor machine finishes any further passes over the work area as specified by the compaction specification.

18 Claims, 2 Drawing Sheets

COMPACTION-BASED DYNAMIC AUTOMATED COMPACTION PLAN

TECHNICAL FIELD

This disclosure relates to road construction equipment, and more specifically to a compaction plan for a compactor machine.

BACKGROUND

Compactors are machines used to compact initially loose materials, such as asphalt, soil, gravel, and the like, to a densified and more rigid mass or surface. For example, soil compactors are utilized to compact soil at construction sites and on landscaping projects to produce a foundation on which other structures may be built. Most soil compactors include a rotatable roller drum that may be rolled over the surface to compress the material underneath. In addition to utilizing the weight of the roller drum to provide the compressive forces that compact the material, some compactors are configured to also induce a vibratory force to the surface.

Traditional approaches to compacting soil, stone, and other materials associated with the worksite surface rely upon operator judgment and perception, and such approaches require substantial operator training and preparation time. These approaches have the potential for human error and tend to result in compacted worksite surfaces that are inconsistent in quality.

Accordingly, pre-planned compaction specifications are provided based on the historical knowledge of certain paving situations. In some examples, an automated compaction plan is developed based on inputting a method specification, which is created with the goal of achieving the desired compaction in the work area.

U.S. Pat. No. 10,640,943 discusses a method to develop a compaction plan and controlling operation of a compactor machine based on the compaction plan.

SUMMARY

In an example according to this disclosure, a method for controlling a compactor machine can include inputting a compaction specification into a controller for compacting a work area; inputting a compaction target value into the controller; while compacting, evaluating an actual compaction value; and if the actual compaction value reaches the compaction target value, the controller being configured to turn off a vibratory system of the compactor machine while the compactor machine finishes any further passes over the work area as specified by the compaction specification.

In another example, a system for autonomous compacting can include a controller to receive a compaction specification for compacting a work area using a compactor machine; the controller configured to receive a compaction target value; one or more sensors to measure an actual compaction value of a portion of the work area; and the controller configured to compare the actual compaction value with the compaction target value and if the actual compaction value reaches the compaction target value, the controller configured to turn off a vibratory system of the compactor machine while the compactor machine finishes any further passes over the work area as specified by the compaction specification.

In another example according to the present disclosure, a compactor machine can include a frame; one or more vibratory drums coupled to the frame; a controller to control a vibratory system of the one or more vibratory drums; and one or more sensors to measure an actual compaction value of a portion of a work area; wherein, the controller being configured to receive a compaction specification for compacting a work area; the controller configured to receive a compaction target value; and the controller configured to compare the actual compaction value with the compaction target value and if the actual compaction value reaches the compaction target value, the controller configured to turn off the vibratory system of the one or more vibratory drums while the compactor machine finishes any further passes over the work area as specified by the compaction specification.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
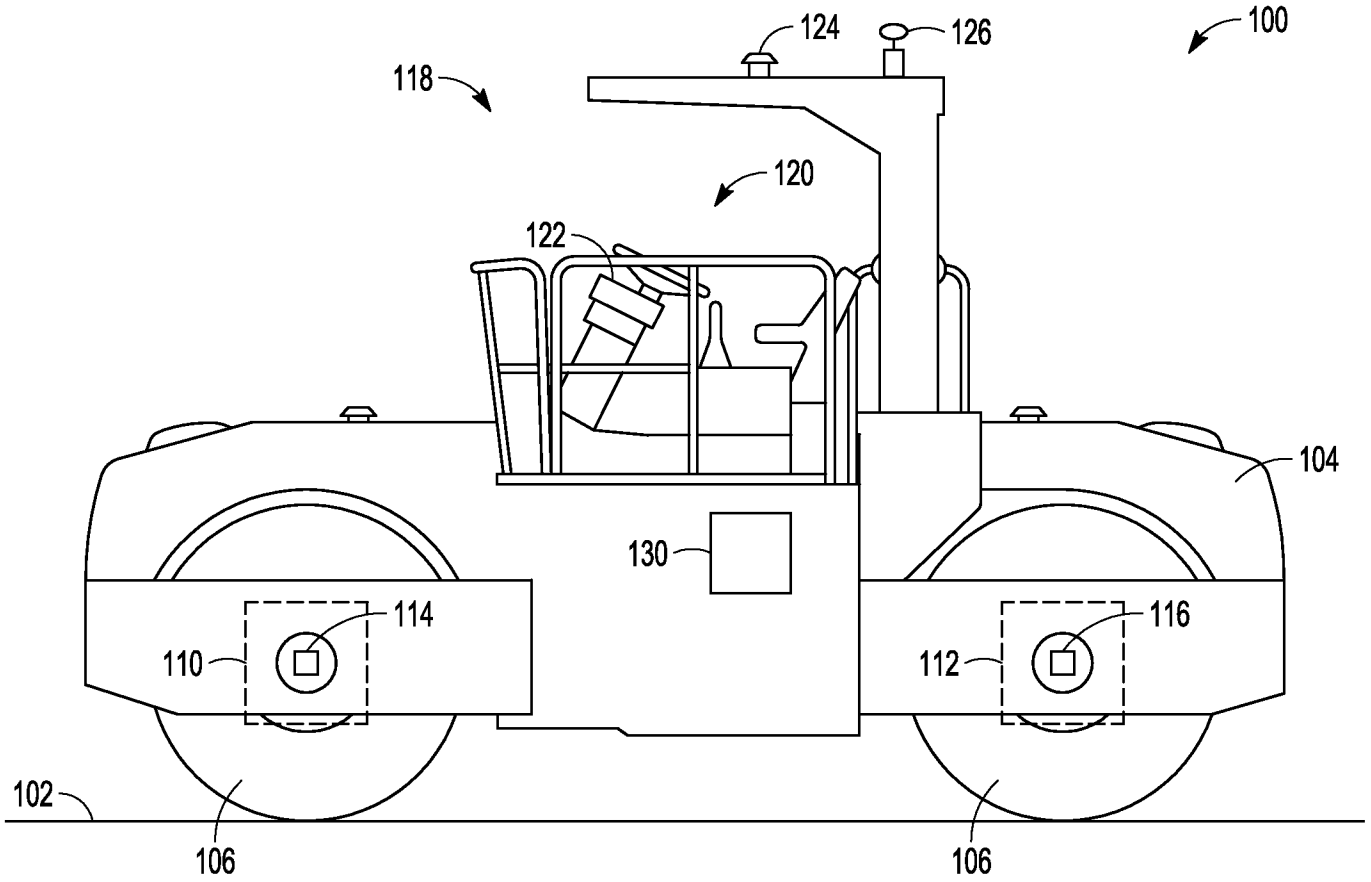
FIG. 1 shows a side view of a compactor machine, in accordance with one embodiment.

FIG. 1 shows an example compactor machine 100. The compactor machine 100 can be used, for example, for soil compaction, road construction, highway construction, parking lot construction, and other such paving and/or construction applications. The compactor machine 100 may make one or more passes over a worksite surface 102 to provide a desired level of compaction. Along with compacting primarily earth-based materials of the worksite surface 102, in other examples, the compactor machine 100 may also be configured to compact freshly deposited asphalt or other materials disposed on and/or associated with the worksite surface 102.

The compactor machine 100 can include a frame 104, a first drum 106, and a second drum 108. The first and second drums 106, 108 may comprise substantially cylindrical drums and/or other compaction elements of the compactor machine 100, and the first and second drums 106, 108 may be configured to apply vibration and/or other forces to the worksite surface 102 in order to assist in compacting the worksite surface 102. The first drum 106 and the second drum 108 may be rotatably coupled to the frame 104 so that the first drum 106 and the second drum 108 may roll over the worksite surface 102 as the compactor machine 100 travels.

The first drum 106 may define a first central axis about which the first drum 106 may rotate, and similarly, the second drum 108 may define a second central axis about which the second drum 108 may rotate. The compactor machine 100 is shown as having first and second drums 106, 108. However, other types of compactor machines 100 may be suitable for use in the context of the present disclosure. For example, belted compaction machines or compaction machines having a single rotating drum, or more than two drums, are contemplated herein. Rather than a self-propelled compactor machine 100 as shown, the compactor machine 100 might be a tow-behind or pushed unit configured to couple with a tractor (not shown). An autonomous compactor machine 100 is also contemplated herein.

The compactor machine 100 can include a vibratory system. For example, the first drum 106 can include a first vibratory mechanism 110, and the second drum 108 may include a second vibratory mechanism 112. While FIG. 1 shows the first drum 106 having a first vibratory mechanism 110 and the second drum 108 having a second vibratory mechanism 112, in other embodiments only one of the first and second drums 106, 108 may include a respective vibratory mechanism 110, 112. Such vibratory mechanisms 110, 112 may be disposed inside the interior volume of the first and second drums 106, 108, respectively. According to an example embodiment, such vibratory mechanisms 110, 112 may include one or more weights or masses disposed at a position off-center from the respective central axis around which the first and second drums 106, 108 rotate. As the first and second drums 106, 108 rotate, the off-center or eccentric positions of the masses induce oscillatory or vibrational forces to the first and second drums 106, 108, and such forces are imparted to the worksite surface 102. The weights are eccentrically positioned with respect to the respective central axis around which the first and second drums 106, 108 rotate, and such weights are typically movable with respect to each other (e.g., about the respective central axis) to produce varying degrees of imbalance during rotation of the first and second drums 106, 108.

The amplitude of the vibrations produced by such an arrangement of eccentric rotating weights may be varied by modifying and/or otherwise controlling the position of the eccentric weights with respect to each other, thereby varying the average distribution of mass (i.e., the centroid) with respect to the axis of rotation of the weights. Vibration amplitude in such a system increases as the centroid moves away from the axis of rotation of the weights and decreases toward zero as the centroid moves toward the axis of rotation. Varying the rotational speed of the weights about their common axis may change the frequency of the vibrations produced by such an arrangement of rotating eccentric weights. In some applications, the eccentrically positioned weights are arranged to rotate inside the first and second drums 106, 108 independently of the rotation of the first and second drums 106, 108.

According to other alternative embodiments, the first and second vibratory mechanisms 110, 112 may be replaced with any other mechanisms that modify the compaction effort of the first drum 106 or the second drum 108. In particular, by altering the distance of the eccentric weights from the axis of rotation, the amplitude portion of the compaction effort is modified. By altering the speed of the eccentric weights around the axis of rotation, the frequency portion of the compaction effort is modified.

According to one embodiment, a sensor 114 may be located on the first drum 106 and/or a sensor 116 may be located on the second drum 108. In alternative embodiments, multiple sensors 114, 116 may be located on the first drum 106, the second drum 108, the frame 104, and/or other components of the compactor machine 100. In such examples, the sensors 114, 116 may comprise compaction sensors configured to measure, sense, and/or otherwise determine the density, stiffness, compaction, compactability, and/or other characteristics of the worksite surface 102. Thus, the one or more sensors 114, 116 can measure an actual compaction value of a portion of a work area.

Such characteristics of the worksite surface 102 may also be based on the operation and/or characteristics of the first drum 106 and/or the second drum 108. For example, the sensor 114 coupled to first drum 106 may be configured to sense, measure, and/or otherwise determine the type of material, material density, material stiffness, and/or other characteristics of the worksite surface 102 proximate the first drum 106. Additionally, the sensor 114 coupled to the first drum 106 may measure, sense, and/or otherwise determine operating characteristics of the first drum 106 including a vibration amplitude, a vibration frequency, a speed of the eccentric weights associated with the first drum 106, a distance of such eccentric weights from the axis of rotation, a speed of rotation of the first drum 106, etc.

Additionally, it is understood that the sensor 116 coupled to the second drum 108 may be configured to determine the type of material, material density, material stiffness, and/or other characteristics of the worksite surface 102 proximate the second drum 108, as well as a vibration amplitude, a vibration frequency, a speed of the eccentric weights associated with the second drum 108, a distance of such eccentric weights from the axis of rotation, a speed of rotation of the second drum 108, etc. It is not necessary to measure all of the operating characteristics of the first drum 106 or second drum 108 listed herein, instead, the above characteristics are listed for exemplary purposes.

Compactor machine 100 can further be equipped with a plurality of other machine sensors that can provide data indicative (directly or indirectly) of various operating parameters of the machine and/or the operating environment in which the machine is operating. The term "sensor" is meant to be used in its broadest sense to include one or more sensors and related components that may be associated with the machine 100 and that may cooperate to sense various functions, operations, and operating characteristics of the machine and/or aspects of the environment in which the machine is operating.

The compactor machine 100 may also include an operator station 118. The operator station 118 may include a steering system 120 including a steering wheel, levers, and/or other controls for steering and/or otherwise operating the compactor machine 100. In such examples, the various components of the steering system 120 may be connected to one or more actuators, a throttle of the compactor machine 100, an engine of the compaction machine, a braking assembly, and/or other such compaction machine components, and the steering system 120 may be used by an operator of the compactor machine 100 to adjust a speed, travel direction, and/or other aspects of the compactor machine 100 during use. The operator station 118 may also include a control interface 122 for controlling various functions of the compactor machine 100. The control interface 122 may comprise an analog, digital, and/or touchscreen display, and such a control interface 122 may be configured to display, for example, at least part of a travel path and/or at least part of a compaction plan of the present disclosure. The control interface 122 may also support other allied functions, including for example, sharing various operating data with one or more other machines (not shown) operating in consonance with the compactor machine 100, and/or with a remote server or other electronic device.

The compactor machine 100 may further include a location sensor 124 connected at one or more locations on the frame 104. The location sensor 124 may be capable of determining a location of the compactor machine 100 and may include and/or comprise a component of a global positioning system (GPS). For example, the location sensor 124 may comprise a GPS receiver, transmitter, transceiver or other such device, and the location sensor 124 may be in communication with one or more GPS satellites to determine a location of the compactor machine 100 continuously, substantially continuously, or at various time intervals.

The compactor machine 100 may also include a communication device 126 configured to enable the compactor machine 100 to communicate with the one or more other machines, and/or with one or more remote servers, processors, or control systems located remote from the worksite at which the compactor machine 100 is being used. Such a communication device 126 may also be configured to enable the compactor machine 100 to communicate with one or more electronic devices located at the worksite and/or located remote from the worksite. In some examples, the communication device 126 may include a receiver configured to receive various electronic signals including position data, navigation commands, real-time information, and/or project-specific information. In some examples, the communication device 126 may also be configured to receive signals including information indicative of compaction specifications for the worksite surface 102.

Such compaction specifications can include one or more of: a machine speed, a number of passes, a vibration amplitude, a vibration frequency, an overlap between work lanes, a maximum number of passes, and the number of static (vibratory system off) passes to perform after a compaction target is reached. The specification is designed in order to complete the compaction of the worksite surface 102 to a desired stiffness, density, and/or compaction of the worksite surface 102.

The compactor machine 100 may also include a controller 130 in communication with the steering system 120, the control interface 122, the location sensor 124, the communication device 126, the sensors 114, 116, and/or other components of the compactor machine 100. The controller 130 may be a single controller or multiple controllers working together to perform a variety of tasks.

In one example, the controller 130 can be configured to generate a compaction plan, one or more travel paths for the compactor machine 100 and/or other information useful to an operator of the compactor machine 100. In some embodiments, the controller 130 may be positioned on the compactor machine 100, while in other embodiments the controller 130 may be positioned at an off-board location and/or remote location relative to the compactor machine 100. The present disclosure, in any manner, is not restricted to the type of controller 130 or the positioning of the controller 130 relative to the compactor machine 100.

Compactor machine 100 may be configured to be operated autonomously, semi-autonomously, or manually. When operating semi-autonomously or manually, the compactor machine 100 may be operated by remote control and/or by an operator physically located within the operator station 118.

As discussed, a compaction plan can be developed based on inputting a method specification, which is created with the goal of achieving the desired compaction in the work area. However, there are more advanced technologies available on the machine today for determining the amount of compaction.

For example, the compactor machine 100 can include a machine drive power (MDP) system. MDP is an energy-based measurement system that correlates compaction with rolling resistance to provide an indication of soil stiffness. Thus, a compaction target value can be set in the MDP system. Another technique to use the MDP system is to compare a percentage change in MDP from pass to pass over an area and use the percentage change as a target value.

In another example, the compactor machine 100 can include a compaction meter value (CMV) system. CMV is an accelerometer-based system that provides an indication of material stiffness. CMV measures only when the vibratory system is active and provides a unitless value calculation derived from the recorded data that indicates composite stiffness. Thus, a compaction target value can be set in the CMV system. Likewise, the system can also compare a percentage change in CMV from one pass to the next and use the percentage change as a target value.

In another example, the compactor machine can include an auto-adjustable compaction (AAC) system. AAC optimizes compaction by delivering the highest amplitude possible without over-compacting. The technology includes both the front drum and rear drum.

The MDP, CMV, or AAC systems can utilize any of sensors 114, 116 or other sensors to perform their functions.

Accordingly, as will be further discussed in detail below, the present system allows the operator to specify a compaction target value (an MDP/CMV target) as part of the work area compaction settings. Once the selected target is achieved in an area or compaction lane, the automatic system can complete a desired number of static passes in that area/lane, skipping any remaining planned passes with the vibratory system enabled. In other words, based on the one or more target compaction values, the system uses the compactor machine vibratory unit to perform or skip a desired number of vibratory or static passes on the compaction area/lane. Also, the system can stop compacting in a compaction lane or a smaller area within a compaction lane when the target criteria are met within a section of the overall work area.

Thus, the controller 130 can be configured to receive a compaction specification for compacting a work area; the controller 130 can be configured to receive a compaction target value; and the controller 130 can be configured to compare an actual compaction value with the compaction target value and if the actual compaction value reaches the compaction target, the controller 130 can be configured to turn off the vibratory system of the one or more drums 106, 108 while the compactor machine finishes any further passes over the work area as specified by the compaction specification.

Figure 2:
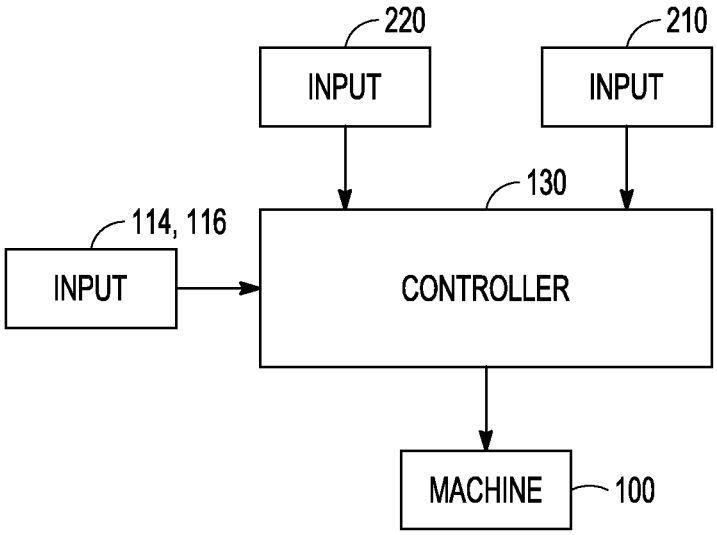
FIG. 2 shows a control system for compacting, in accordance with one embodiment.

For example, FIG. 2 shows a control system for compacting, in accordance with one embodiment. Here, the control system include the controller 130 to receive a compaction specification 210 for compacting a work area using a compactor machine 100. The controller 130 can be configured to receive a compaction target value 220 and one or more sensors 114, 116 to measure an actual compaction value of a portion of the work area. The controller 130 can be configured to compare the actual compaction value from the sensors 114, 116 with the compaction target value 220 and if the actual compaction value reaches the compaction target value, the controller 130 can be configured to turn off a vibratory system of the compactor machine 100 while the compactor machine finishes any further static passes over the work area as specified by the compaction specification.

In one example, receiving the compaction specification 210 can include the controller 130 receiving one or more of: a machine speed, a number of passes, a vibration amplitude, a vibration frequency, an overlap between work lanes a maximum number of passes, and a number of static passes to perform after a compaction target is met.

Receiving the compaction target value 220 includes receiving a desired compaction level. For example, the target value can include the operator specifying a specific MDP/CMV target.

Thus, the user can input a CMV target into the controller 130 and when the CMV target is reached, the vibratory system is shut off during any further static passes by the compactor machine 100. In some examples, the system can utilize RTK (real-time kinetic) level accuracy to provide the highest level of Global Navigation Satellite System positioning (GNSS) and is able to correlate compaction, frequency, and pass-count data to specific location. In one example, the input can be an MDP target.

In one example, measuring the actual compaction value can include directly or indirectly measuring a density of a surface of the work area or measuring another value indicative of the level of compactness of the surface either using sensors 114, 116 or other sensors as part of the MDP, CMV, or ACC systems.

After turning off the vibratory system, the controller 130 can continue to monitor the actual compaction level and the controller 130 can turn the vibratory system back on in another area of the work area if the actual compaction value changes. Thus, each area or lane may be vibrated more or less depending on the input to the controller 130. The present system allows for a dynamic compaction system, with real-time changes to be made.

The system can include a debounce technique for turning off the vibratory system. For example, the controller can determine the time or distance traveled at the target compaction before turning off the vibratory system. If a certain time or distance is travelled without the compaction target being reached, the vibratory system can be turned back on. This will help limit a continuous on/off cycle.

In one example, there can also be a maximum amplitude configured in the vibratory system. For example, this can include starting at a configured maximum amplitude (for example, a high amplitude, medium amplitude, or low amplitude) and decreasing amplitude automatically when decoupling is detected for a threshold amount of time. The same technique is then used at each level of vibratory amplitude.

This will allow the system to show metrics on how compaction is building toward the target with each pass, estimate the time remaining based on how compaction is building, and identify areas requiring additional attention. For instance, if an area reaches the target value much more quickly or does not reach the target within the maximum number of passes, the system can warn the operator or show in an offboard system and suggest possible actions. For example, the soil properties may differ from the expected values (moisture, material composition, etc.).

INDUSTRIAL APPLICABILITY

The present system is applicable during many situations in road construction. For example, the present system can be used for soil compactors, and asphalt compactors.

Figure 3:
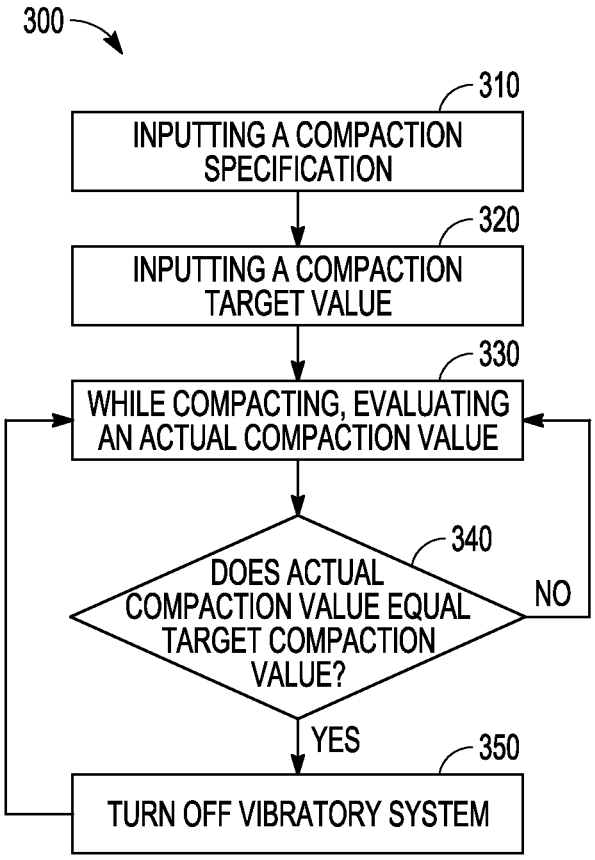
FIG. 3 shows a method for controlling a compactor machine, in accordance with one embodiment.

FIG. 3 shows a method (300) for controlling a compactor machine, in accordance with one embodiment. The method (300) can include inputting a compaction specification (310) into a controller for compacting a work area; inputting a compaction target value (320) into the controller; while compacting, evaluating an actual compaction value (330); and if the actual compaction value reaches the compaction target value (340), the controller being configured to turn off a vibratory system (350) of the compactor machine while the compactor machine finishes any further static passes over the work area as specified by the compaction specification.

In one example, inputting the compaction specification include inputting one or more of: a number of passes, a vibration amplitude, a vibration frequency, and an overlap between work lanes.

Inputting a compaction target value can include inputting a desired compaction level. In one example, and MDP target can be used. In one example, the desired compaction level can include a CMV target.

Evaluating the actual compaction value can include utilizing one or more sensors on the machine to measure a density of a surface.

In the method, after turning off the vibratory system, the controller can turn the vibratory system back on in another area of the work area if the actual compaction value changes. Thus, over an entire worksite, the controller can turn the vibratory system off and on depending on feedback from the various sensors and system utilized. The GPS location allows the controller to know the locations and relative compaction of every area of the worksite and this allows for a dynamic compaction plan that can change in real-time.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A method for controlling a compactor machine comprising:

inputting a compaction specification into a controller for compacting a work area;

inputting a compaction target value into the controller;

while compacting, evaluating an actual compaction value; and if the actual compaction value reaches the compaction target value, the controller being configured to turn off a vibratory system of the compactor machine while the compactor machine finishes any further passes over the work area as specified by the compaction specification, wherein after turning off the vibratory system, the controller turning the vibratory system back on in another area of the work area if the actual compaction value changes.

2. The method of claim 1, wherein inputting the compaction specification include inputting one or more of: a number of passes, a vibration amplitude, a vibration frequency, and an overlap between work lanes.

3. The method of claim 1, wherein inputting a compaction target value includes inputting a desired compaction level.

4. The method of claim 3, wherein the desired compaction level includes a compaction meter value target.

5. The method of claim 4, wherein evaluating the actual compaction value includes using a drum-mounted accelerometer to measure and record forces of one or more vibrating drums to determine a composite stiffness value of a surface.

6. The method of claim 3, wherein the desired compaction level includes a percentage of compaction change between passes over a same area target value.

7. The method of claim 3, wherein the desired compaction level includes an MDP target.

8. The method of claim 1, wherein evaluating the actual compaction value includes utilizing one or more sensors on the compactor machine to measure a density of a surface.

9. A system for autonomous compacting comprising:

a controller to receive a compaction specification for compacting a work area using a compactor machine, wherein the compaction specification includes a number of passes;

the controller configured to receive a compaction target value;

one or more sensors to measure an actual compaction value of a portion of the work area; and the controller configured to compare the actual compaction value with the compaction target value and if the actual compaction value reaches the compaction target value, the controller configured to turn off a vibratory system of the compactor machine while the compactor machine finishes any remaining passes over the work area as static passes as specified by the number of passes included in the compaction specification.

10. The system of claim 9, wherein receiving the compaction specification include the controller receiving one or more of: a number of passes, a vibration amplitude, a vibration frequency, and an overlap between work lanes.

11. The system of claim 9, wherein receiving a compaction target value includes receiving a desired compaction level.

12. The system of claim 11, wherein the desired compaction level includes a compaction meter value target, and wherein evaluating the actual compaction value includes using a drum-mounted accelerometer to measure and record forces of one or more vibrating drums to determine a composite stiffness value of a surface.

13. The system of claim 11, wherein the desired compaction level includes an MDP target.

14. The system of claim 11, wherein the desired compaction level includes a percentage of compaction change between passes over a same area target value.

15. The system of claim 9, wherein measuring the actual compaction value includes measuring a density of a surface of the work area.

16. The system of claim 9, wherein after turning off the vibratory system, the controller turning the vibratory system back on in another area of the work area if the actual compaction value changes.

17. A compactor machine comprising:

a frame;

one or more vibratory drums coupled to the frame;

a controller to control a vibratory system of the one or more vibratory drums; and one or more sensors to measure an actual compaction value of a portion of a work area;

wherein, the controller being configured to receive a compaction specification for compacting a work area; the controller configured to receive a compaction target value; and the controller configured to compare the actual compaction value with the compaction target value and if the actual compaction value reaches the compaction target value, the controller configured to turn off the vibratory system of the one or more vibratory drums while the compactor machine finishes any further passes over the work area as specified by the compaction specification, wherein after turning off the vibratory system, the controller configured to turn the vibratory system back on in another area of the work area if the actual compaction value changes.

18. The compactor machine of claim 17, wherein receiving the compaction specification include the controller receiving one or more of: a number of passes, a vibration amplitude, a vibration frequency, and an overlap between work lanes.

* * * * *